US005188285A

United States Patent [19]

Nilsson et al.

[11] Patent Number: 5,188,285

[45] Date of Patent: Feb. 23, 1993

[54] OPENING DEVICE FOR PACKAGING CONTAINERS

[75] Inventors: Bo Nilsson; Doriano Ottocan, both of Lund, Sweden; Per Sponholtz, Gentofte, Denmark

[73] Assignee: Tetra Alfa Holdings S.A., Pully, Switzerland

[21] Appl. No.: 770,323

[22] Filed: Oct. 3, 1991

[30] Foreign Application Priority Data

Oct. 24, 1990 [SE] Sweden ..... 9003397

[51] Int. Cl.[5] ..... B65D 5/54

[52] U.S. Cl. ..... 229/242; 229/116; 229/216; 229/240

[58] Field of Search ..... 229/116, 87.05, 213, 229/216, 240, 243, 244, 241, 242; 383/207, 209, 208

[56] References Cited

U.S. PATENT DOCUMENTS

| | | | |
|---|---|---|---|
| 809,050 | 1/1906 | Goldmann | 229/243 |
| 1,516,090 | 11/1924 | Gary et al. | 229/243 |
| 2,127,646 | 8/1938 | Luery | 229/243 |
| 2,143,646 | 1/1939 | Chapman | 229/243 |
| 2,305,428 | 12/1942 | Johnson | 383/209 |
| 2,833,404 | 5/1958 | Jacobs et al. | 229/241 |
| 3,043,472 | 7/1962 | Nemoede | 229/242 |
| 3,074,612 | 1/1963 | Schneider | 383/207 |
| 3,083,876 | 4/1963 | Schneider et al. | 229/116 |
| 3,298,596 | 1/1967 | Tolaas et al. | 229/241 |
| 3,325,081 | 6/1967 | Mahon | 229/244 |
| 3,379,360 | 4/1968 | Crossley | 229/116 |
| 3,404,988 | 10/1968 | Rausing | 229/216 |
| 3,692,226 | 9/1972 | Young et al. | 229/240 |
| 3,770,185 | 11/1973 | Reeves | 229/213 |
| 4,301,927 | 11/1981 | Carlsson et al. | 229/216 |
| 4,344,537 | 8/1982 | Austin | 229/243 |
| 4,915,236 | 4/1990 | Kamin et al. | 229/216 |

FOREIGN PATENT DOCUMENTS

| | | |
|---|---|---|
| 2320190 | 11/1973 | Fed. Rep. of Germany . |
| 164649 | 7/1990 | Norway . |
| 313237 | 8/1969 | Sweden . |

*Primary Examiner*—Gary E. Elkins

*Attorney, Agent, or Firm*—Burns, Doane, Swecker & Mathis

[57] ABSTRACT

In an opening device for tetrahedral-shaped or parallel piped-shaped packaging containers, a strip of packaging material is provided with tear perforation lines substantially parallel to the longitudinal direction of the strip of material. The tear perforation lines intersecting a transverse seam on the packaging material are located relative to one another such that they converge at a point in a finished packaging container.

16 Claims, 2 Drawing Sheets

OPENING DEVICE FOR PACKAGING CONTAINERS

FIELD OF THE INVENTION

This invention relates to opening devices for packaging containers and, more particularly, to opening devices for packaging containers that are manufactured from a continuous strip of material.

BACKGROUND OF THE INVENTION

Packaging containers of the type which are manufactured from a continuous strip of material, often a material of paper or cardboard laminated with plastic and possibly with aluminium foil, are transversely sealed across the strip of material after forming the strip of material into a tube the tubular strip of material is then cut off through the transverse seals into individual packaging containers. By orienting the transverse seals differently one can obtain packaging containers of various appearance. By folding every second transverse seam in half to be at a 90° angle relative to the previous transverse seam, one obtains packaging containers of tetrahedral form. By orienting all transverse seams in the same direction, one obtains cushion shaped packaging objects which, following another shaping can be brought to a parallelepiped shape.

Regardless of which type of packaging container shape is being manufactured, packaging containers are provided with many different types of opening devices. The majority of opening devices are intended for liquid contents with pouring edges and similar arrangements. Such opening devices are often less suitable for semi-liquid or almost solid products. Semi-liquid products may be such as tomato paste or fresh cream. Almost solid products are often those which have been packaged in liquid form and since congealed in the packaging such as puddings, cream cheese and also more conventional types of cheese. When one wishes to empty out the contents of packagings containing almost a solid products, it is often desirable to open a fairly large part of the packaging and here there is most frequently no means available other than using scissors, knife or similar household implement to cut along one side and thereby dig the contents of the package out with a spoon or tip them out.

OBJECTS AND SUMMARY OF THE INVENTION

An aim of the present invention is to open one side of a packaging container in a simple manner not requiring an implement in order to more easily reach the semi-solid or semi-liquid contents.

This and other aims have been achieved according to the invention. An opening device for packaging containers of the type manufactured from a continuous strip of material is shaped into a tube with transverse seams at right angles to the longitudinal direction of the strip of material and the tube. The two perforation lines extending mainly in the strip's longitudinal direction coincide with a transverse seam on the packaging containers manufactured from the strip of material.

DESCRIPTION OF THE DRAWINGS

A preferred embodiment of the invention will now be described in greater detail with reference to the following drawings.

DETAILED DESCRIPTION

The continuous strips of material 1, 2, from which various forms of packaging containers 3, 4 are manufactured, have a core of paper or cardboard to which various layers of thermoplastic and possibly aluminium foil are laminated. Before the lamination it is relatively simple to provide the strip of material 1, 2 with tear perforation lines 5, 6 and after that the strip 1, 2 is laminated in the usual way. Because the tear perforation lines 5, 6 run mainly in the longitudinal direction of the strip 1, 2, there is little effect on the strength of the packaging material due to the weakening of the strip 1, 2 along these lines as the main stress on the strip of material 1, 2 is oriented in the same direction as the tear perforation lines 5, 6. The tear perforation lines 5, 6 further, do not at any point deviate more than 45° from the longitudinal direction.

Figure 1:
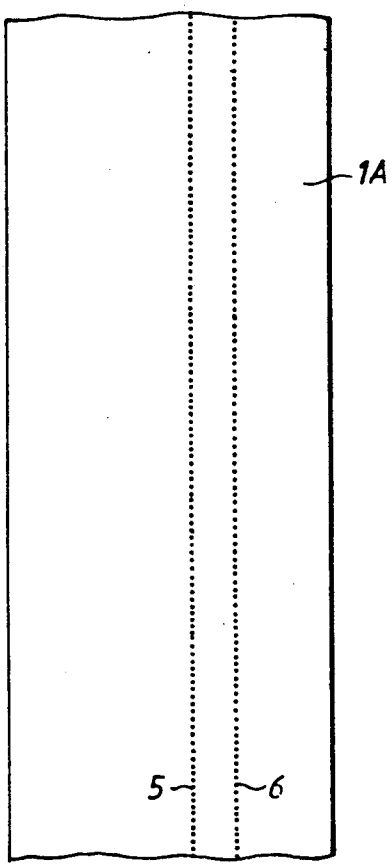
FIG. 1 is a part of a strip of material for tetrahedral-shaped packaging containers.

FIG. 1 shows a part of a strip of material 1A intended for tetrahedral-shaped packaging containers 3. This strip 1A is completely without preprinted fold lines and it most frequently does not need to be kept in register either. On this strip of material 1A there are two tear perforation lines 5, 6 which run parallel to the edge of the strip of material 1A. The width between the tear perforation lines 5, 6 is chosen so that half the width is fully sufficient to offer a thumb grip when tearing off the packaging wall and opening the packaging container 3A. Naturally the width can vary depending on the product and the desired degree of opening.

Figure 3:
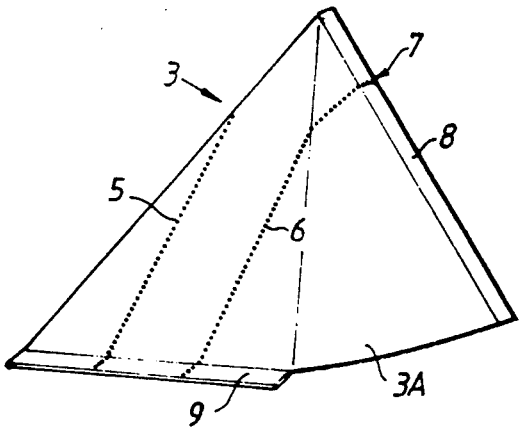
FIG. 3 is a perspective view of a tetrahedral-shaped packaging container with an opening device.

The tear perforation lines 5, 6 are oriented towards the side of the strip 1A so that in the finished packaging container 3A, shown in FIG. 3, the tear perforation lines 5, 6 coincide at a point 7 or a line on one transverse seam 8, which is completely necessary since this creates an indication for tearing when one starts to open the packaging container 3. The transverse seam 8 is preferably formed by sealing the inner surface of a tube (not shown) formed from a strip of material 1, 2 to itself. The other transverse seam 9 is preferably formed in the same manner.

Figure 2:
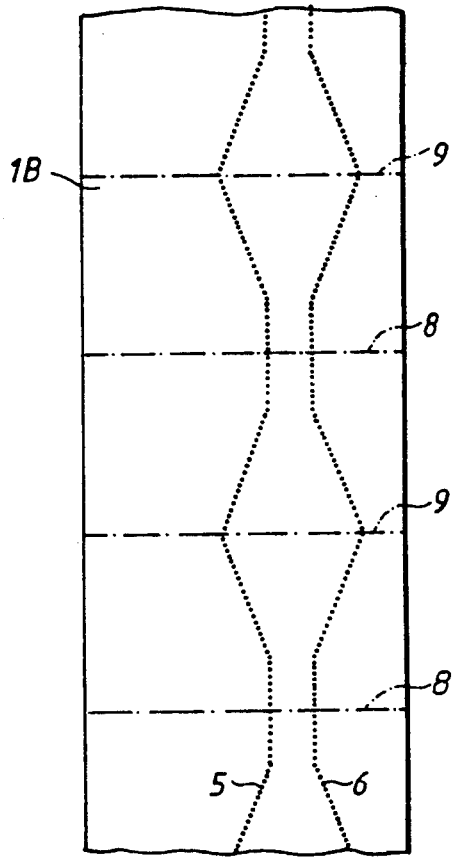
FIG. 2 is a part of another strip of material for tetrahedral-shaped packaging containers.

FIG. 2 shows another strip of material 1B which is intended for tetrahedral-shaped packaging containers 3. Here too there are no preprinted fold lines, but in this case it is necessary to keep the strip of material 1B in register, i.e., the transverse seams 8, 9 must occur at definite positions on the strip 1B in order to ensure that the tear perforation lines 5, 6 come exactly so that one side of the tetrahedral-shaped packaging 3B can be opened almost in its entirety (although not actually present on the strip of material 1B, the transverse seams 8, 9 are shown for comparative purposes with respect to the location of the transverse seams on the finished packaging container 3 shown in FIG. 4.). Two parallel tear perforation lines 5, 6 coincide with a transverse seam 8 at a point 7 provides a guide to indicate the point at which tearing is to begin. The position of the transverse seams 8, 9 is indicated by means of dotted lines on the strip of material 1B in FIG. 2. From these two parallel tear perforation lines 5, 6 the tear The tear perforation lines 5, 6 include portions that are parallel to one another as they cross one traverse seam 8, then diverge until they cross the next traverse seam. After crossing the traverse seam 9, the tear perforation lines 5, 6 converge again and become parallel as before, and cross the next repetition of the transverse seam 8. The two originally parallel tear perforation lines diverge and converge alternately along the length of the strip of material 1B.

Figure 4:
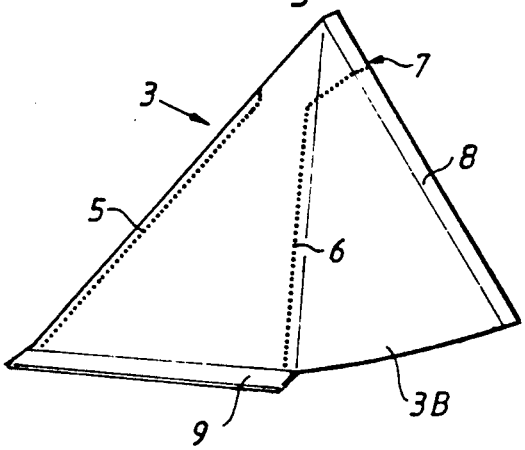
FIG. 4 is a perspective view of a tetrahedral-shaped packaging container with another version of the opening device.

In the case that is shown in FIG. 2 the packaging container 3B will be given an appearance as shown in FIG. 4 where there is a point of coincidence 7 on one transverse seam 8 for the two partly parallel tear perforation lines 5, 6. From the parallel position the tear perforation lines 5, 6 diverge so that they very closely coincide with the limit lines for a side surface of a tetrahedral-shaped packaging container 3B. An opening device is thus obtained since vistually one whole side of the tetrahedral-shaped packaging container 3B is torn off in opening the packaging container 3B.

Figure 5:
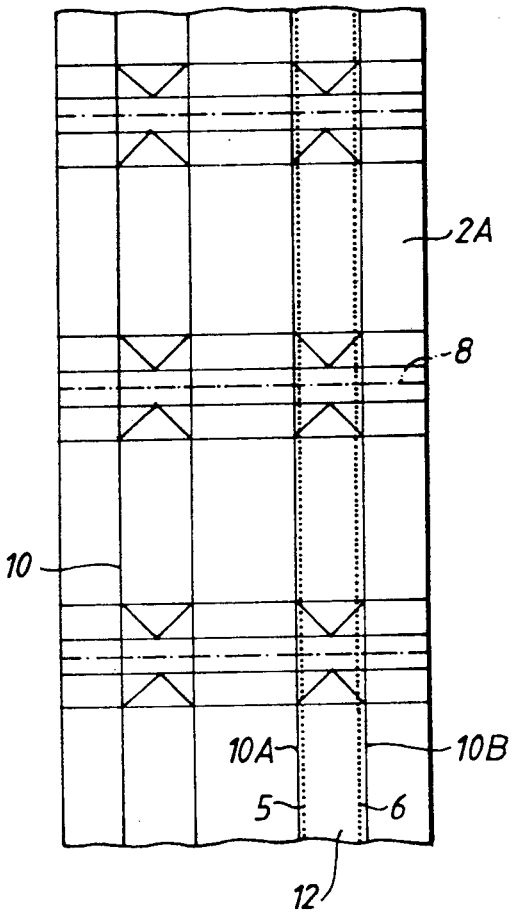
FIG. 5 is a perspective view of a part of a strip of material for parallelepiped-shaped packaging containers.
Figure 7:
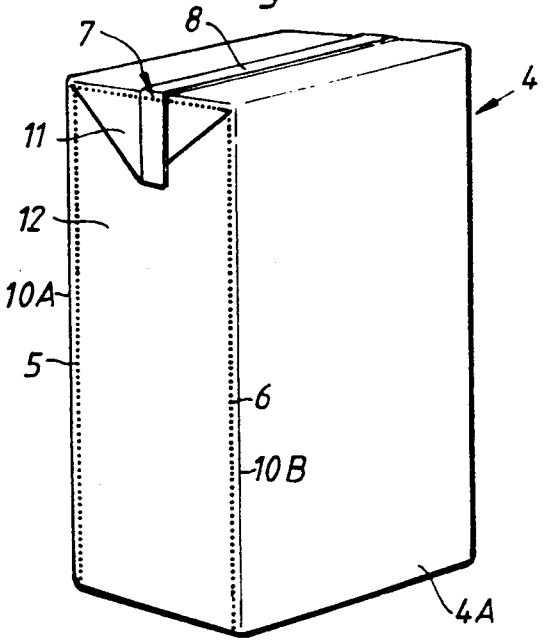
FIG. 7 is a perspective view of a parallelepiped-shaped packaging container with an opening device.

In FIG. 5 a part of a strip of material 2A is shown which is intended for parallelepiped-shaped packaging containers 4. This strip 2A is preprinted with so-called bend lines 10. The strip 2A is cut off in transverse seams 8 which are all oriented in the same dirction and thereafter the cushion-shaped packaging object is finally shaped to its parallelepiped shape. In FIG. 5 the continuous strip of material 2A has been provided with tear perforation lines 5, 6 which are located at a distance from each other which is less than the distance between two bend lines 10A, 10B, which constitute the limit of the side on the finished parallelepiped-shaped container 4. The two tear perforation lines 5, 6 are symmetrically placed in relation to the fold lines 10A, 10B to coincide at a point 7 of the two transverse seams 8 of the packaging container 4. With similar tear perforation lines 5, 6 to those shown in FIG. 5 the finished parallelepiped-shaped packaging containers 4A will have the appearance of the packaging container of FIG. 7. At the opening of this container 4A the flap which is to be found on the side 12, which is provided with tear perforation lines 5, 6, is lifted up. This arrangement provides a thumb grip and a tear guide and allows almost the whole side 12 of the packaging container 4A to be torn off. The distance between the tear perforation lines 5, 6 within the two fold lines 10A, 10B which mark the side 12 can vary depending on the desired degree of opening and depending on what product has been packaged.

Figure 6:
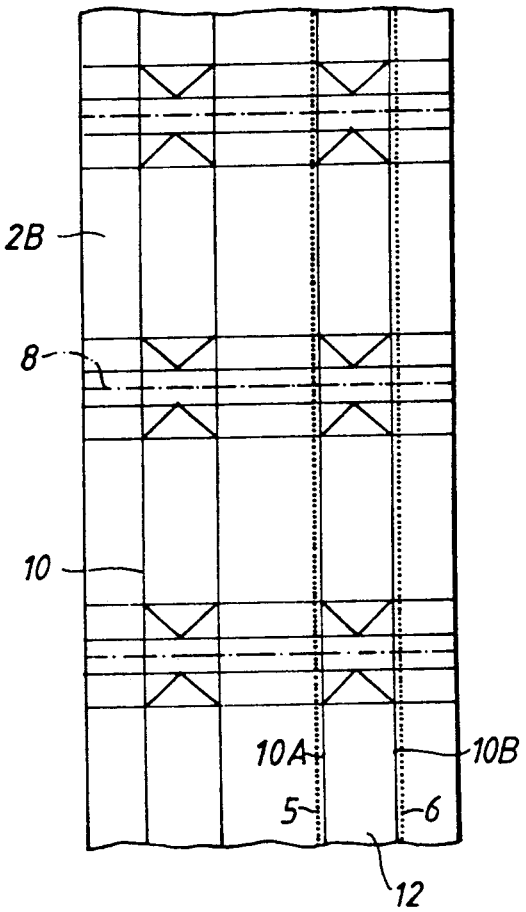
FIG. 6 is a part of another strip for parallelepiped-shaped packaging containers.
Figure 8:
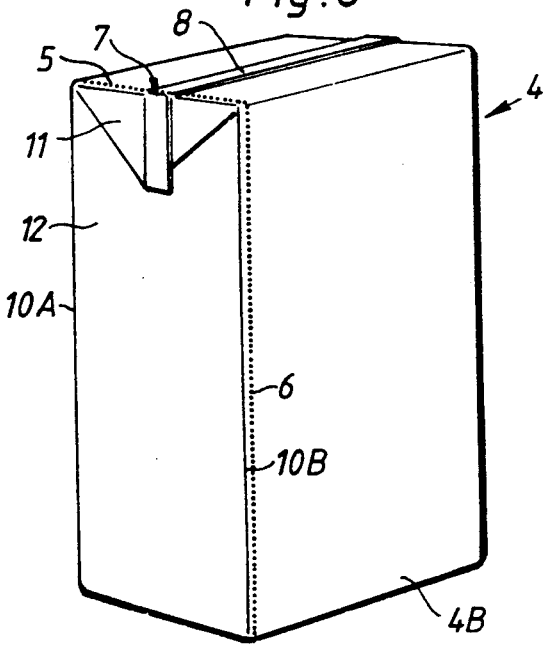
FIG. 8 is a perspective view of a parallelepiped-shaped packaging container with another version of the opening device.

In FIG. 6 another strip of material 2B is shown. This strip 2B can also form a parallelepiped-shaped packaging containers 4 provided with preprinted fold lines 10. Here the two tear perforation lines 5, 6 have between them a greater distance than the two fold lines 10A, 10B which constitute the limit of one side 12. The tear perforation lines are placed symmetrically in relation to the fold lines 10A, 10B. With a strip of packaging material 2B as in FIG. 6 one obtains packaging containers 4B with an appearance as shown in FIG. 8. This packaging container 4B also is opened by lifting the flap 11 and provides a tear guide at the point 7 where the tear perforation lines 5, 6 meet. Naturally the width between the tear perforation lines can also be varied here depending on the degree of opening desired and on what is packaged in the packaging container.

Another embodiment of the inventions depicted in FIGS. 5 and 6 consists of locating the tear perforation lines 5, 6 to coincide with the fold lines 10A, 10B which constitute the limiting surface of one gable 12 of the packaging container. This container is opened by tearing off one of its side 12 in its entirety.

As is clear from the above description an opening device for packaging containers is achieved with the present invention which makes it possible in a simple and inexpensive manner to open a greater part of the packaging container in order thus to be able in a simple manner to gain access to the contents of the packaging container. While this invention has been illustrated and described in accordance with a preferred embodiment, it is recognized that variations and changes may be made therein without departing from the invention as set forth in the claims.

What is claimed is:

1. A packaging container with an opening device, comprising:

a packaging container manufactured from a continuous strip of material, the continuous strip of material being formed into a tube having an inner surface, said tube being cut at first and second transverse seams at right angles to a longitudinal direction of the strip of material, the first transverse seam being closed so that the inner surface of the tube is sealed to itself and the second transverse seam being closed on itself to form the packaging container, the first and second closed transverse seams being positioned at opposite ends of the packaging container;

an opening device manufactured with the packaging container from the continuous strip of material, the opening device being formed by two continuous perforation lines extending, in a direction on the packaging container corresponding to the longitudinal direction of the continuous strip of material, to the first and second closed transverse seams on the packaging container such that the packaging container may be opened from the first closed transverse seam to the second closed transverse seam, the two perforation lines coinciding at a point at the first closed transverse seam.

2. A packaging container with an opening device as set forth in claim 1, wherein the second transverse seam is closed at 90° in relation to the first closed transverse seam, and the perforation lines are mainly parallel.

3. A packaging container with an opening device as set forth in claim 1, wherein the second transverse seam is closed at 90° in relation to the first closed transverse seam, and a first transverse distance between the perforation lines decreases from the second closed transverse seam to a second transverse distance and then forms two parallel lines extending to the first closed transverse seam.

4. A packaging container with an opening device as set forth in claim 1, wherein the first and second transverse seams are closed parallel to each other, a portion of the continuous strip of material for forming the container has preprinted pattern of parallel longitudinal, parallel transverse, and diagonal fold lines, and the perforation lines are mainly parallel.

5. A packaging container with an opening device as set forth in claim 4, wherein the perforation lines coincide at a point at the second closed transverse seam of the packaging container.

6. A packaging container with an opening device as set forth in claim 4, wherein a first distance between the perforation lines is less than a second distance between two fold lines which constitute limit lines for a side on the packaging container.

7. A packaging container with an opening device as set forth in claim 4, wherein a first distance between the perforation lines is greater than a second distance between two fold lines which constitute limit lines for a side on the packaging container.

8. A packaging container with an opening as set forth in claim 4, wherein the perforation lines coincide with two fold lines which constitute limit lines for a side on the finished packaging container.

9. In a packaging container formed from a continuous strip of packaging material having longitudinal edges and formed into a tube having an inner surface, with individual containers formed by closing two regularly spaced transverse seams at right angles to a longitudinal direction of the tube, the inner surface being sealed to itself at a first one of said transverse seams, said closed transverse seams being positioned at opposite ends of said container, the improvement of an opening arrangement comprising a pair of continuous perforation lines extending substantially longitudinally of said strip of material, said perforation lines extending a distance greater than the distance separating said transverse seams, said perforation lines providing an opening arrangement extending to each of said closed transverse seams such that the packaging container may be opened from the first one of said closed transverse seams to a second one of said closed transverse seams, said perforation lines coinciding at the first one of said closed transverse seams.

10. The packaging container according to claim 9 wherein the closed transverse seams of said packaging container are oriented at about 90° in relation to each other.

11. The packaging container according to claim 9 wherein the closed transverse seams of said packaging container are oriented in parallel relation to each other.

12. The packaging container according to claim 10 wherein said perforation lines diverge from each other adjacent the first one of said closed transverse seams and converge toward each other adjacent the second one of said closed transverse seams.

13. The packaging container according to claim 11 wherein said container is in the shape of a parallelepiped, and said perforation lines extend along adjacent corners of the parallelepiped container and continuously between said closed transverse seams.

14. In a packaging container formed from a continuous strip of packaging material having longitudinal edges and formed into a tube, with individual containers formed by closing two regularly spaced transverse seams at right angles to a longitudinal direction of the tube, the improvement of an opening arrangement comprising a pair of continuous perforation lines extending substantially longitudinally of said strip of material, said perforation lines extending a distance greater than the distance separating said transverse seams, and thereby providing an opening arrangement extending to each of said closed transverse seams;

wherein the closed transverse seams of said packaging container are oriented at about 90° in relation to each other;

wherein said perforation lines diverge from each other adjacent a first one of said closed transverse seams and converge toward each other adjacent a second one of said closed transverse seams; and wherein said container is in the shape of tetrahedron.

15. An opening arrangement for a tetrahedral shaped packaging container having four substantially triangular sides and two seams extending along different corners formed between the sides, said seams being arranged at substantially 90° to each other, said opening arrangement including a pair of perforation lines extending continuously from one of said seams to the other of said seams.

16. The opening arrangement according to claim 15 wherein said seams have substantially the same length, said pair of perforation lines intersecting one of said seams adjacent opposite ends of said one seam and intersecting the other of said seams intermediate opposite ends of said other seam.

* * * * *